US005759116A

United States Patent [19]

Kasasima et al.

[11] Patent Number: 5,759,116

[45] Date of Patent: Jun. 2, 1998

[54] GOLF BALL

[75] Inventors: Atuki Kasasima; Keisuke Ihara; Hirotaka Shimosaka; Michio Inoue; Yutaka Masutani, all of Chichibu, Japan

[73] Assignee: Bridgestone Sports Co., Ltd., Tokyo, Japan

[21] Appl. No.: 806,774

[22] Filed: Feb. 26, 1997

[30] Foreign Application Priority Data

Feb. 26, 1996 [JP] Japan ..... 8-063802

[51] Int. Cl.[6] ..... A63B 37/14

[52] U.S. Cl. ..... 473/384; 425/90; 264/241

[58] Field of Search ..... 473/383, 384

[56] References Cited

U.S. PATENT DOCUMENTS 4,915,389 4/1990 Ihara ..... 473/383

5,467,994 11/1995 Moriyama et al. ..... 473/384 X

*Primary Examiner*—George J. Marlo

*Attorney, Agent, or Firm*—Sughrue, Mion, Zinn, Macpeak & Seas, PLLC

[57] ABSTRACT

In a golf ball, dimples are arranged in its spherical surface such that a great circle which does not intersect with the dimples is not drawable on the ball surface, thereby preventing any drop of symmetry caused by the presence of a seam line. The dimples are further arranged such that a percent dimple volume VR given as (B/A)×100% is in the range: 0.6%<VR<1.5% wherein a phantom sphere given on the assumption that the spherical surface of the ball is free of dimples has a volume of A $mm^3$ and the sum of the volumes of dimples distributed throughout the ball is B $mm^3$, thereby optimizing the percent dimple volume to ensure a longer carry.

5 Claims, 10 Drawing Sheets

GOLF BALL

BACKGROUND OF THE INVENTION

1. Field of the Invention

This invention relates to a golf ball having dimples arranged so as to provide improved aerodynamic symmetry, offering advantages including a satisfactory flight distance, no variation in distance and trajectory with an impact point, and stable flight performance.

2. Related Art

The flying performance of golf balls is greatly affected by the arrangement and configuration (including diameter, depth and cross-sectional shape) of dimples. In order to improve flying performance, various geometrical dimple arrangements on the ball surface in a uniform or close spaced fashion have been proposed in the art.

Demands for the flying performance of golf balls concentrate on the flight distance. In fact, most players desire a further increase of flight distance.

One important factor governing the flight properties of golf balls is aerodynamic symmetry. It is prescribed in the Rules of Golf, Appendix III, the Ball, c. spherical symmetry. It is required that no significant difference occur in carry or trajectory when a ball is hit at different points. Conventional golf balls currently commercially available possess symmetry within the range prescribed in the Rules, but not to a sufficient extent to satisfy every player. There is a desire for a further improvement in aerodynamic symmetry.

More particularly, currently available golf balls have a so-called seam line, which is one cause that deteriorates aerodynamic symmetry. Since a golf ball is generally molded in a mold including a pair of mold halves each having a hemi-spherical cavity surface, a parting line known as a seam line is formed on the molded ball at the junction between the mold halves. The seam line thus corresponds to a phantom great circle with which none of the dimples intersect. Because of this manufacturing process, a seam line inevitably exists on every golf ball.

Reference is now made to FIGS. 8(A) and 8(B) wherein a golf ball 30 has a seam line 32 and a center 36. The ball hitting is generally classified into pole hitting and seam hitting depending on an impact point. The pole hitting means that the ball 30 is hit at arrow 40 so as to give back spin about a straight line 38 connecting two diametrically opposed points 34, 34 on the seam line 32 and the center 36 as shown in FIG. 8(A). The seam hitting means that the ball 30 is hit at arrow 46 so as to give back spin about a straight line 44 extending perpendicular to a circular plane 42 circumscribed by the seam line 32 and passing the center 36. Then a difference in trajectory and carry occurs between the pole hitting and the seam hitting.

If a ball used is somewhat aerodynamically asymmetrical, this asymmetry can cause inconsistent shots when low-handicap and professional golfers play therewith. Therefore, an improvement in aerodynamic symmetry is an important task in improving the flight performance of golf balls.

Therefore, an object of the present invention is to provide a novel and improved golf ball which is improved in aerodynamic symmetry, flight distance and flight performance.

Another object of the invention is to provide a method for preparing a golf ball.

SUMMARY OF THE INVENTION

According to a first aspect of the invention, there is provided a golf ball having a plurality of dimples in its spherical surface. A great circle which does not intersect with the dimples is not drawable on the ball surface. A total dimple volume to ball volume ratio VR given as (B/A)×100% is in the range: 0.6%<VR<1.5% wherein a phantom sphere given on the assumption that the spherical surface of the ball is free of dimples has a volume of A $mm^3$ and the sum of the volumes of dimples distributed throughout the ball is B $mm^3$.

In one preferred embodiment, twelve congruent phantom spherical equilateral hexagons and six congruent phantom spherical equilateral tetragons are drawn on the ball surface such that each phantom spherical equilateral tetragon is surrounded by four phantom spherical equilateral hexagons and the four sides of each phantom spherical equilateral tetragon are coincident with respective one sides of the four phantom spherical equilateral hexagons surrounding the tetragon, and three diagonal lines are drawn in each of the phantom spherical equilateral hexagons to equally divide the phantom spherical equilateral hexagon into six phantom spherical triangles. Then the ball surface is divided into seventy two phantom spherical triangles and six phantom spherical equilateral tetragons. The dimples are arranged on the ball surface such that the phantom spherical triangles have an identical dimple arrangement and the phantom spherical equilateral tetragons have another identical dimple arrangement.

In a further preferred embodiment, an identical number of dimples intersect with every side of the seventy two phantom spherical triangles and the six phantom spherical equilateral tetragons.

In the golf ball of the invention, dimples are distributed on the ball surface such that a great circle which does not intersect with the dimples is not drawable on the ball surface, thereby preventing any drop of symmetry otherwise caused by the presence of a seam line. Dimples are also provided such that the ratio VR of total dimple volume to ball volume may fall in the above-defined range, thereby optimizing the percent dimple volume for enabling an increase of carry.

In the preferred embodiment, the ball surface is divided into 72 phantom spherical triangles and 6 phantom spherical equilateral tetragons, and the dimples are arranged on the ball surface such that the phantom spherical triangles have an identical dimple arrangement and the phantom spherical equilateral tetragons have another identical dimple arrangement. This distribution of dimples provides uniform dimple effect throughout the ball surface, thereby achieving a further improvement in aerodynamic symmetry. In the further preferred embodiment, dimples are distributed such that an identical number of dimples intersect with each of the sides of the 72 phantom spherical triangles and the 6 phantom spherical equilateral tetragons. Then the spacing between dimples is uniform throughout the ball, resulting in superior aerodynamic symmetry.

In a second aspect, the invention provides a method for preparing a golf ball as defined above using a mold comprising a pair of separable mold halves wherein each mold half defines a hemi-spherical cavity having a plurality of dimple-shaping protrusions on its inner surface. The mold halves define a closed spherical cavity having dimple-shaping protrusions on its inner surface when mated at their abutment surfaces to provide a parting line. The mold halves are provided in the abutment surfaces with a plurality of pin insertion grooves which are in communication with the cavity. Dimple-shaping pins are inserted through the pin insertion grooves such that their inner end may protrude into the cavity whereby the inner ends of the dimple-shaping pins define dimple-shaping protrusions along the parting line of the cavity. The resulting cavity has the dimple-shaping protrusions on the mold halves and the dimple-shaping protrusions defined by the inner ends of the dimple-shaping pins such that a great circle which does not intersect with the dimple-shaping protrusions may not be drawable on the cavity inner surface. According to the inventive method, the golf ball is prepared by placing a core in the mold cavity in alignment to define a space therebetween, and feeding a cover stock into the space for forming a cover layer around the core, the cover layer being formed with a plurality of dimples in its surface.

In one preferred embodiment, the dimple-shaping pins are retractable and the method further involves the steps of: advancing the dimple-shaping pins into the mold cavity for supporting the core at the center of the cavity; feeding the cover stock into the space between the mold cavity and the core supported by the dimple-shaping pins; retracting the dimple-shaping pins from the cavity to a dimple-shaping position immediately before the space is completely filled with the cover stock; and causing the cover stock to solidify on the core whereby dimples are also formed along the parting line between the mold halves.

According to the method of the invention, a golf ball is prepared by using a mold comprising a pair of separable mold halves wherein each mold half defines a hemispherical cavity, placing a core in the cavity, and injection molding a cover stock to form a cover around the core while dimples are formed in the cover surface. A plurality of dimple-shaping protrusions are provided on the cavity inner surface of the mold so as to satisfy the above-defined dimple arrangement according to the invention. Dimple-shaping pins are inserted between the mold halves such that their inner end may protrude into the cavity whereby the inner ends of the dimple-shaping pins define dimple-shaping protrusions along the parting line of the cavity. As inversion of the dimple-shaping protrusions, dimples are formed along the parting line, thereby obtaining a golf ball free of a great circle which does not intersect with the dimples.

In the preferred embodiment wherein the dimple-shaping pins are retractable, the dimple-shaping pins can be used as support pins for supporting the core in the mold cavity at the center to the last minute before the space is completely filled with the cover stock.

BRIEF DESCRIPTION OF THE DRAWINGS

These and further features of the present invention will be apparent with reference to the following description and drawings, wherein.

DETAILED DESCRIPTION OF THE INVENTION

As usual, a golf ball has a plurality of dimples in its spherical surface. The invention requires that the ball is free of a great circle which does not intersect with the dimples, and a ratio VR of total dimple volume to ball volume is in the range: $0.6\% < VR < 1.5\%$.

Figure 1:
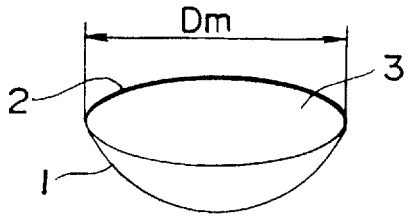
FIGS. 1(A) and 1(B) are schematic views illustrating how to calculate the volume of a dimple.
Figure 1:
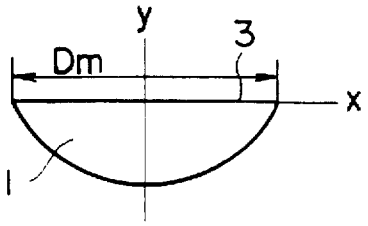

As used herein, the total dimple volume to ball volume ratio (simply referred to as percent dimple volume) VR is given as $(B/A)\times 100\%$ wherein a phantom sphere given on the assumption that the spherical surface of the ball is free of dimples has a volume of A $mm^3$ and the sum of the volumes of dimples distributed throughout the ball is B $mm^3$. As the volume of a sphere is mathematically determined, the volume A of a phantom sphere is determined as $A=4\pi r^3/3$ wherein r is a radius of the phantom sphere. The sum B of the volumes of dimples is determined as B=(volume VD of a dimple)×(total number of dimples) if the dimples are of one type. If the dimples are of two or more types, the sum of the volumes of dimples is determined for each of the plural types and such sums are added. The volume VD of a dimple is calculated as follows. Referring to FIG. 1(A), a dimple 1 has an outer periphery 2 which circumscribes a phantom circular plane 3 having a diameter Dm. As shown in FIG. 1(B), a straight line passing the deepest bottom of the dimple 1 and the center of the phantom circular plane 3 is y axis, and a straight line passing in the phantom circular plane 3 and orthogonal to y axis is x axis. The volume VD of a dimple is then determined according to the following expression (1):

$$VD = \int_0^{\frac{Dm}{2}} 2\pi xy\,dx \tag{1}$$

In the practice of the invention, the dimples may be either of one type or of plural types. Often, one, two or three types of dimples are distributed on a ball. There may be two or more types of dimples which are different in diameter and/or depth. It is preferred that the dimples have a diameter of 2 to 5 mm and a depth of 0.07 to 0.30 mm. The size of a dimple is not critical. If dimples are small, then the number of dimples is naturally increased in order to satisfy the percent dimple volume VR. If dimples are large, then the number of dimples is naturally decreased in order to satisfy the percent dimple volume VR. Preferably, the dimples are sized such that the sum B of the volumes of dimples is equal to 244 to 610 $mm^3$, especially 325 to 447 $mm^3$. The total number of dimples is preferably 250 to 600, especially 350 to 500.

In the golf ball of the invention, dimples are designed such that the percent dimple volume VR is more than 0.6% and less than 1.5%. Preferably VR is in the range: $0.8\% \leqq VR \leqq 1\%$, especially $0.85\% \leqq VR \leqq 0.95\%$. With such dimple design, the ball in flight generates effective turbulent flow around it to reduce air resistance and receives an optimum lift due to the back spin, thereby traveling an increased flight distance. The invention wherein the percent dimple volume VR is controlled to fall within the above-defined range and dimples are distributed so that a great circle which does not intersect with the dimples is not drawable on the ball surface is effective in improving aerodynamic symmetry. Consequently, both flight distance and symmetry are improved at the same time.

The arrangement of dimples is not critical insofar as a great circle which does not intersect with dimples does not exist on the ball surface. For example, the ball surface may be divided into regular octahedral, dodecahedral or icosahedral regions by a well-known division method and dimples are equally arranged in each of the divided regions. In one preferred embodiment of the invention, the ball surface is divided into seventy two (72) phantom spherical triangles and six (6) phantom spherical equilateral tetragons, and dimples are arranged within the phantom spherical triangles in an identical arrangement and also within the phantom spherical equilateral tetragons in another identical dimple arrangement. This dimple arrangement ensures to improve aerodynamic symmetry. More preferably, an equal number of dimples intersect with the sides of the 72 phantom spherical triangles and the 6 phantom spherical equilateral tetragons. This ensures that the spacing between dimples is uniform throughout the ball, leading to further improved aerodynamic symmetry.

More illustratively, some exemplary dimple arrangements are shown in FIGS. 2 and 3, FIG. 4, and FIG. 5.

The spherical surface of a ball is divided as shown in FIGS. 2 to 5. Twelve congruent phantom spherical equilateral hexagons 4 and six congruent phantom spherical equilateral tetragons 5 are drawn on the ball surface such that each phantom spherical equilateral tetragon 5 is surrounded by four phantom spherical equilateral hexagons 4 and the four sides of each phantom spherical equilateral tetragon 5 are coincident with respective one sides of the four phantom spherical equilateral hexagons 4 surrounding the tetragon 5. Three diagonal lines 6, 6, 6 are drawn in each of the phantom spherical equilateral hexagons 4 to equally divide the phantom spherical equilateral hexagon 4 into six phantom spherical triangles 7, 7, . . . , 7. It is noted that in the figures, diagonal lines 6 are drawn as dot-and-dash lines in only one of the phantom spherical equilateral hexagons 4. The ball surface is then divided into seventy two (72) phantom spherical triangles 7 and six (6) phantom spherical equilateral tetragons 5. According to the invention, the dimples are arranged on the ball surface such that the phantom spherical triangles 7 have an identical dimple arrangement and the phantom spherical equilateral tetragons 5 have another identical dimple arrangement.

Figure 2:
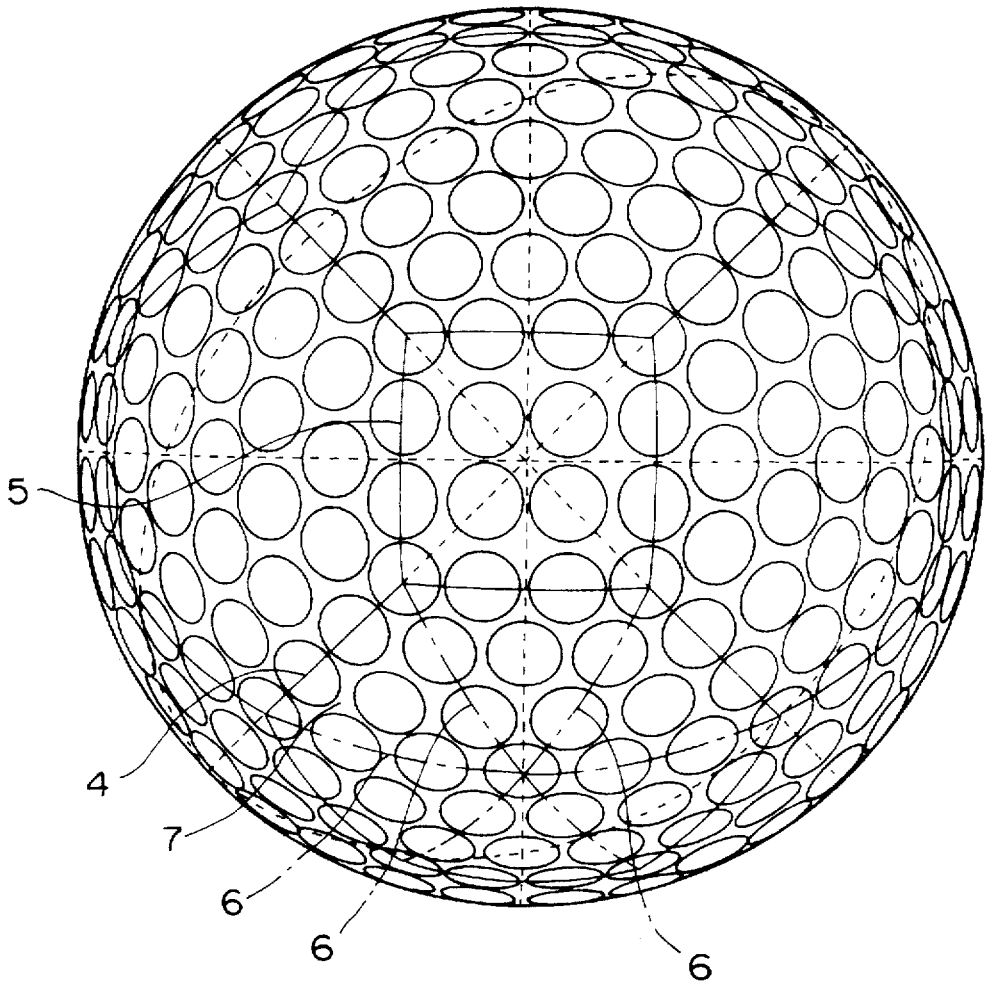
FIG. 2 schematically illustrates the pattern of dimple arrangement on a golf ball according to one embodiment of the invention.
Figure 3:
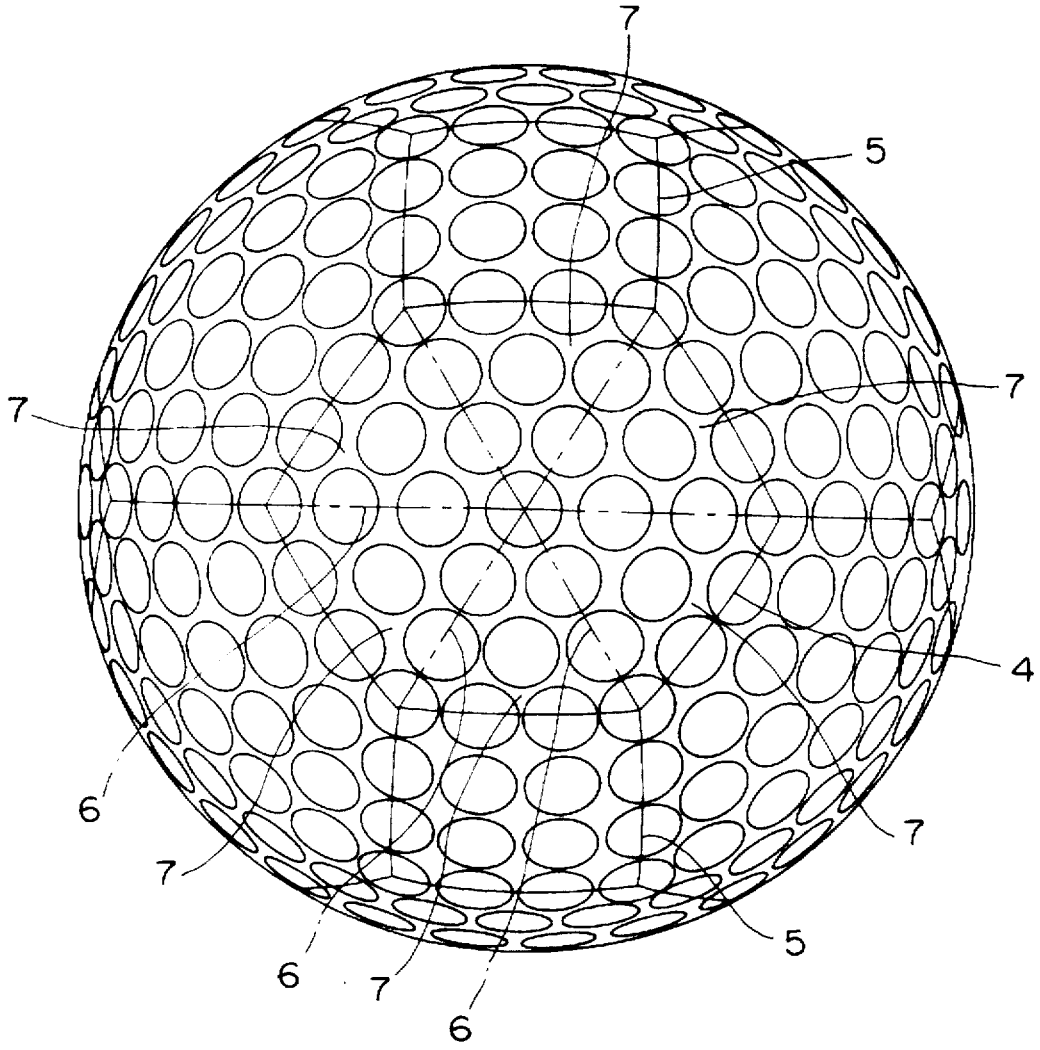
FIG. 3 illustrates the same dimple arrangement pattern as in FIG. 2 when viewed from a different angle.
Figure 4:
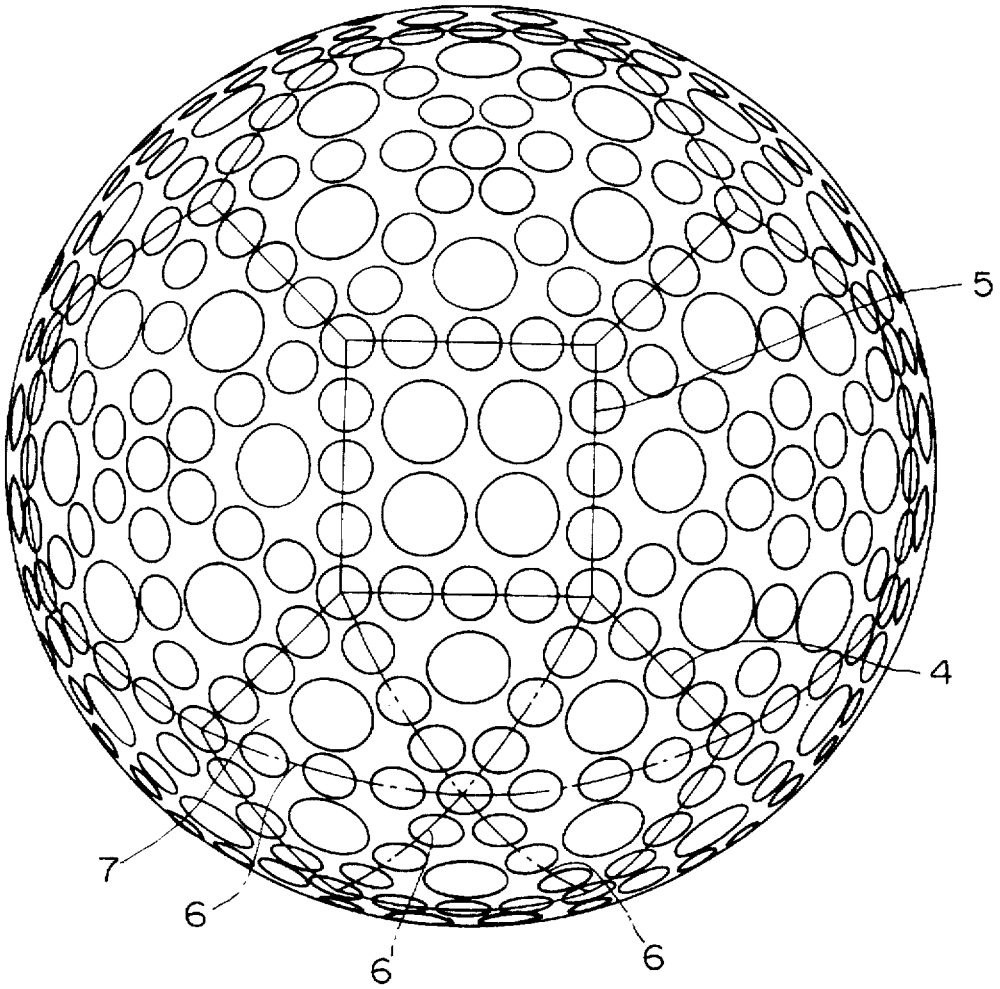
FIG. 4 schematically illustrates the pattern of dimple arrangement on a golf ball according to another embodiment of the invention.
Figure 5:
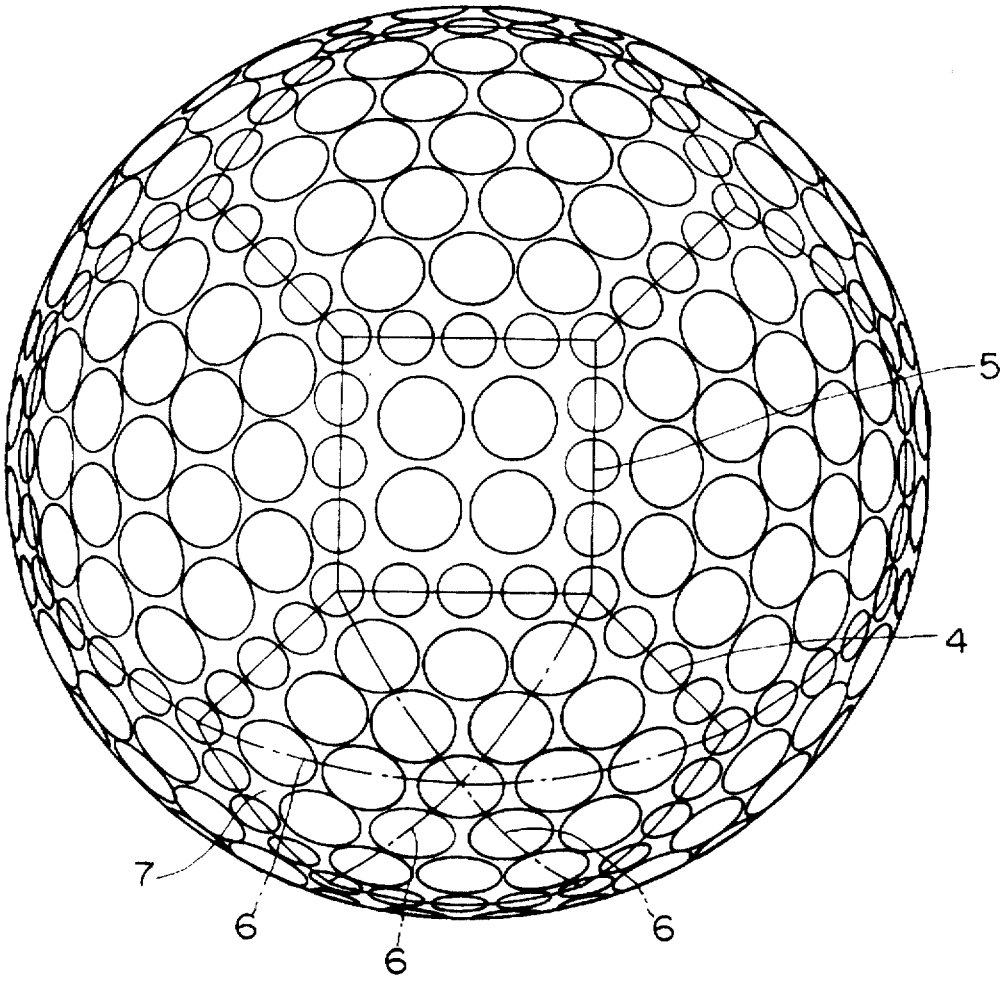
FIG. 5 schematically illustrates the pattern of dimple arrangement on a golf ball according to a further embodiment of the invention.

It is preferred that an equal number of dimples intersect with the sides of the phantom spherical triangles 7 and the phantom spherical equilateral tetragons 5 as in the dimple arrangements shown in FIGS. 2 and 3 and FIG. 4. It is seen that four dimples intersect with the sides of triangles 7 and tetragons 5 in the arrangement of FIGS. 2 and 3, and five dimples intersect with the sides of triangles 7 and tetragons 5 in the arrangement of FIG. 4. Further preferably, the number of dimples intersecting with each side is three, four or five.

It is understood that FIGS. 2 to 5 illustrate how to divide the ball surface although the dimple arrangement is not limited to these embodiments. It is only required that an identical dimple arrangement be provided in all the phantom spherical triangles 7 and another identical dimple arrangement be provided in all the phantom spherical equilateral tetragons 5.

Figure 6:
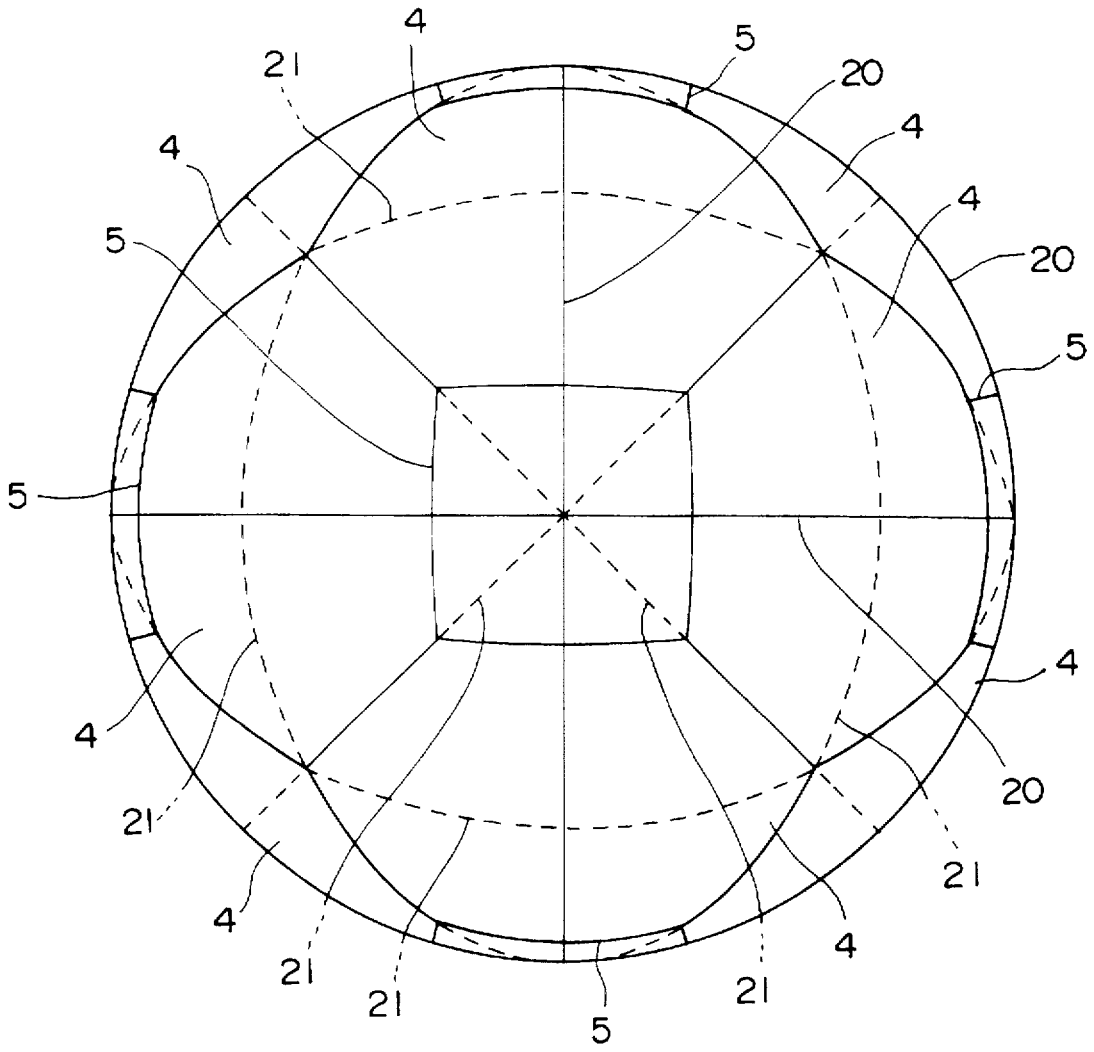
FIG. 6 schematically illustrates the manner of dividing the golf ball surface into 12 phantom spherical equilateral hexagons and 6 phantom spherical equilateral tetragons.

The manner of dividing the ball surface into twelve congruent phantom spherical equilateral hexagons 4 and six congruent phantom spherical equilateral tetragons 5 is as follows. As shown in FIG. 6, the ball surface is first divided as a well-known regular octahedron (numeral 20 designates lines of division as a regular octahedron). Median lines 21, 21, . . . . 21 are drawn from the apexes of the spherical regular triangles constituting the spherical regular octahedron. A phantom spherical equilateral tetragon 5 is drawn in a region of the spherical regular octahedron disposed adjacent to its apex, with such orientation that the corners of the tetragon 5 are positioned on the median lines 21. One side of the phantom spherical equilateral tetragon 5 forms one half of a phantom spherical equilateral hexagon 4 with the median lines 21. In this way, the ball surface is divided into twelve phantom spherical equilateral hexagons 4 and six phantom spherical equilateral tetragons 5.

Insofar as the golf ball of the invention has dimples arranged as mentioned above, the structure and material of the ball are not critical. Either solid golf balls including one-piece balls and two-piece balls or wound golf balls can be prepared using conventional well-known materials. The size, weight and other parameters may be properly selected in accordance with the Rules of Golf.

Conventional methods may be used for the preparation of the golf ball of the invention. For example, a two-piece solid golf ball is prepared as follows. There is furnished a mold comprising a pair of separable mold halves wherein each mold half defines a hemi-spherical cavity having a plurality of dimple-shaping protrusions on its inner surface. When the mold halves are mated at their abutment surfaces or along a parting line, the mold halves define a closed spherical cavity having a first plurality of dimple-shaping protrusions on its inner surface. A core is placed in the mold cavity in alignment to define a space therebetween, and a cover stock is fed into the space for forming a cover layer around the core. At the same time as molding, the cover layer is formed with a plurality of dimples in its surface. Since the golf ball of the invention is free of a great circle which does not intersect with dimples as mentioned above, molding must be done such that there is not formed a seam line (a great circle which does not intersect with dimples) which is otherwise formed in conventional golf balls at a position corresponding to the parting line between the mold halves.

Figure 7:
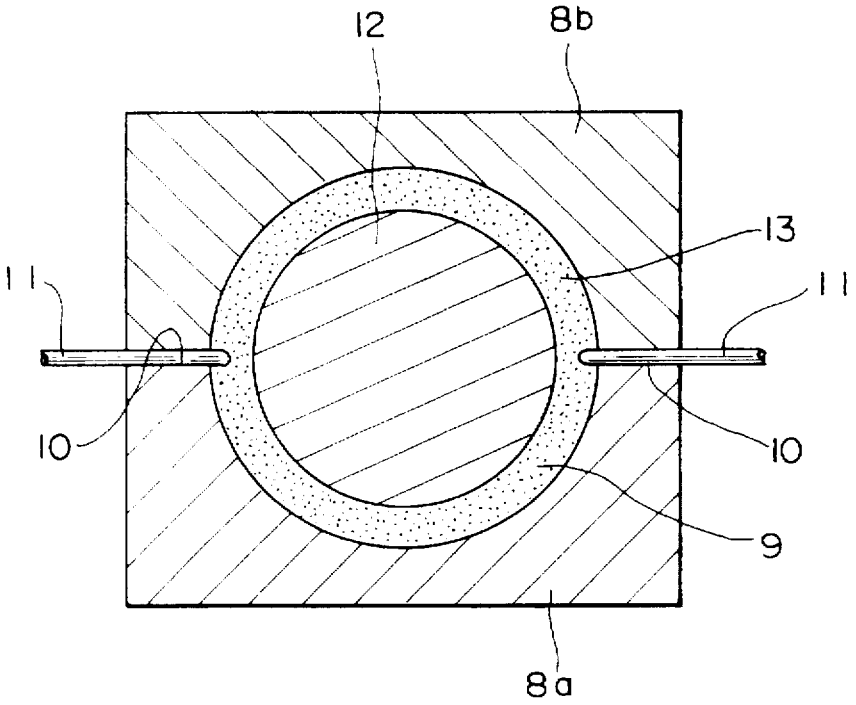
FIG. 7 is a schematic cross-sectional view of an exemplary mold used in the method of the invention.

To this end, a mold consisting of mold halves **8*a* and 8*b* is modified as shown in FIG. 7, for example. The mold halves 8*a* and 8*b* are provided in the abutment surfaces with a plurality of pin insertion grooves 10 which are in communication with a mold cavity 9. Dimple-shaping pins 11 are inserted through the pin insertion grooves 10 such that their inner end may protrude into the cavity as just shown in FIG. 7. Then the inner ends of the dimple-shaping pins 11 define a second plurality of dimple-shaping protrusions along the parting line of the cavity 9. The resulting cavity 9 has the first plurality of dimple-shaping protrusions (not shown) on the mold halves and the second plurality of dimple-shaping protrusions defined by the inner ends of the dimple-shaping pins 11 such that a great circle which does not intersect with the dimple-shaping protrusions may not be drawable on the cavity inner surface. With a core 12 placed in the mold cavity in alignment to define a space therebetween, a cover stock is fed into the space for forming a cover layer 13 (without a seam line) around the core 12**.

When a golf ball is prepared by the method using the mold shown in FIG. 7, it is preferred that the dimple-shaping pins 11 are retractable. Prior to molding, the dimple-shaping pins 11 are advanced deeply into the mold cavity 9 for supporting the core 12 at the center of the cavity. A cover stock is fed into the space between the mold cavity inner surface and the core 12 supported by the dimple-shaping pins 11. The dimple-shaping pins 11 are retracted from the cavity 9 to a dimple-shaping position (the illustrated position) immediately before the space is completely filled with the cover stock. The cover stock is solidified on the core whereby dimples are also formed along the parting line between the mold halves.

The cavity-defining inner surface of the mold in which a golf ball is molded according to the invention is free of a great circle which does not intersect with dimple-shaping protrusions. In addition, the dimple-shaping protrusions are distributed such that there is obtained a golf ball in which a percent dimple volume VR given as (B/A)×100% is in the range: 0.6%<VR<1.5% wherein a phantom sphere given on the assumption that the spherical surface of the ball is free of dimples has a volume of A $mm^3$ and the sum of the volumes of dimples distributed throughout the ball is B $mm^3$. Then there is obtained a golf ball having a dimple arrangement according to the invention.

The golf ball and the method according to the invention have the following advantages. (1) The total dimple volume relative to the ball volume is optimum. (2) A great circle which does not intersect with dimples does not exist in a golf ball. (3) The geometrical arrangement of dimples is improved so as to provide an equal spacing between dimples. (4) The provision of dimple-shaping protrusions along the parting line of the mold ensures preparation of a seam line-free ball. (5) Accordingly, the ball is given consistent flight performance in that not only the flight distance is increased, but also symmetry is satisfactory in the sense that the flight performance does not substantially vary between different positions at which the ball is struck.

EXAMPLE

Examples of the present invention are given below by way of illustration and not by way of limitation.

Example 1 and Comparative Example 1

A large size two-piece solid golf ball having a dimple arrangement as shown in FIGS. 2 and 3 was manufactured using a mold as shown in FIG. 7. This golf ball contained 380 dimples of the same type having a diameter of 3.8 mm and had a percent dimple volume VR of 0.92%.

Figure 8A:
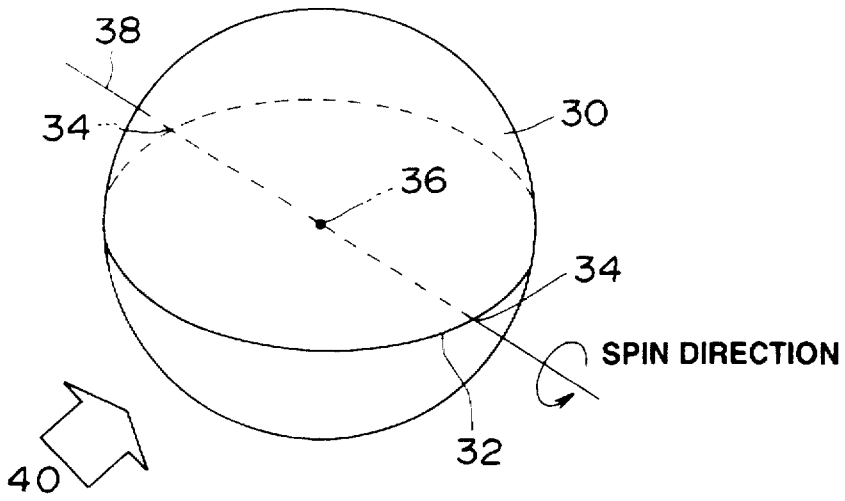
FIG. 8 illustrates the direction in which a golf ball is hit by a club, FIG. 8(A) corresponding to pole hitting and FIG. 8(B) corresponding to seam hitting.
Figure 8B:
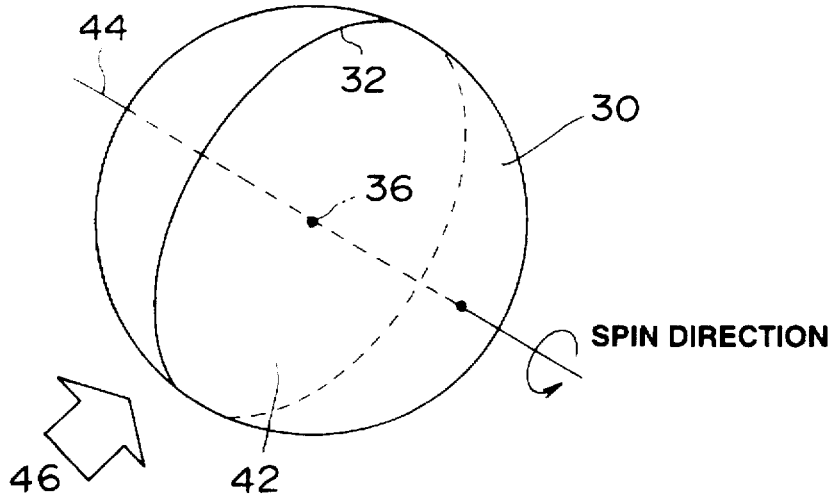

The golf ball was subject to a hitting test. It was assumed that a great circle corresponding to the parting line of the mold was a seam line. The ball was repeatedly hit with a driver (#W1) at a head speed of 45 m/sec. by pole hitting in the direction of arrow 40 in FIG. 8(A) and seam hitting in the direction of arrow 46 in FIG. 8(B). The carry, run and total travel distance (expressed in meter) were measured. An average of ten measurements is reported. The results are shown in Table 1.

Figure 9:
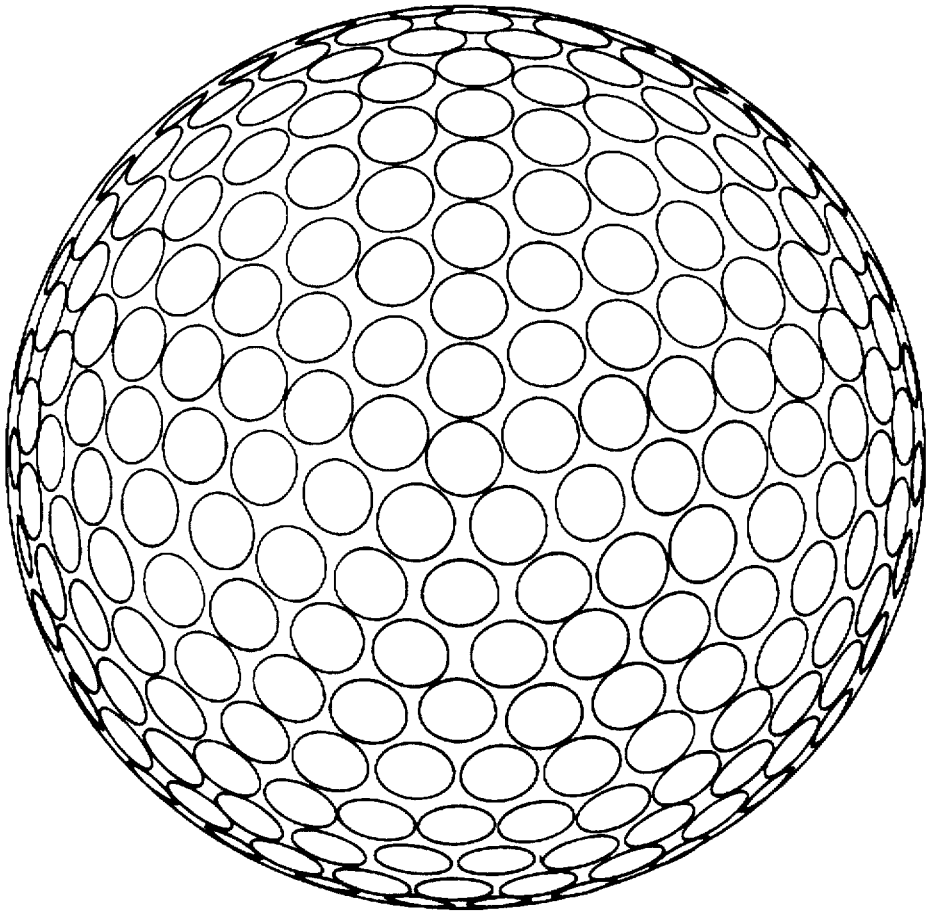
FIG. 9 schematically illustrates the pattern of dimple arrangement on a golf ball used in Comparative Example.
Figure 10:
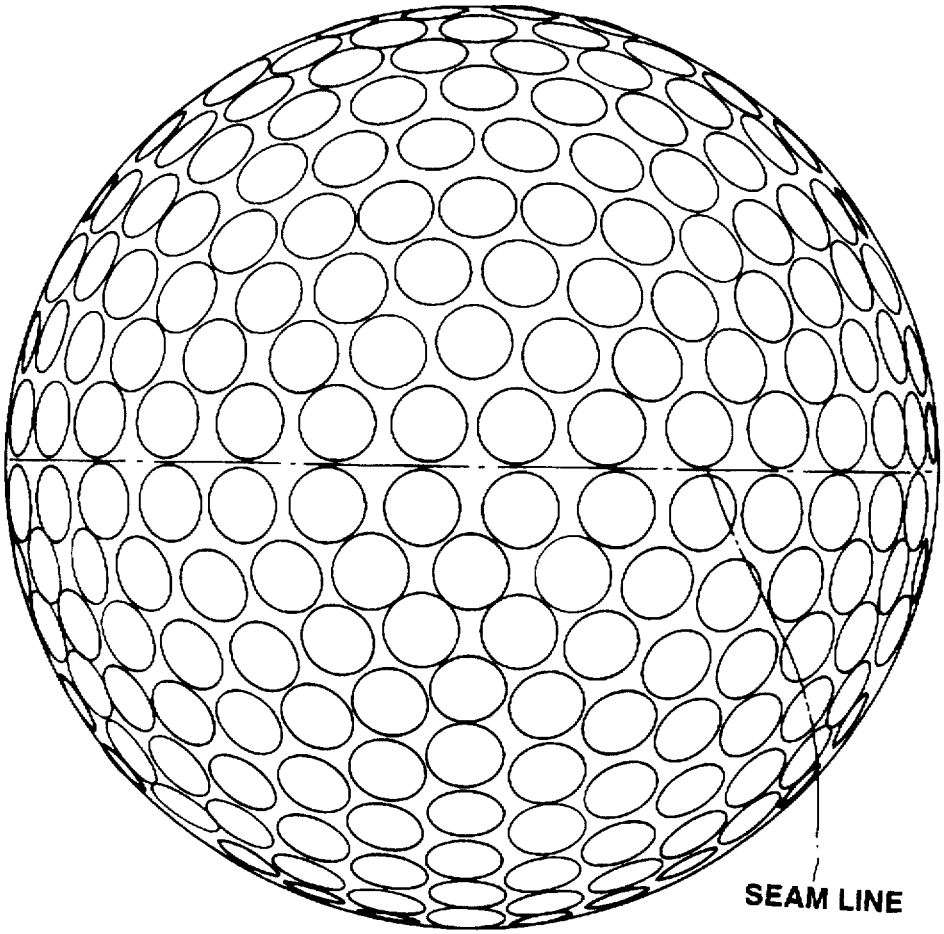
FIG. 10 illustrates the same dimple arrangement pattern as in FIG. 9 when viewed from a different angle.

For comparison purposes, the same test was done on a large size two-piece solid golf ball having such a dimple arrangement that a seam line which did not intersect with dimples existed as shown in FIGS. 9 and 10. This golf ball contained 392 dimples of the same type having a diameter of 3.63 mm and had a percent dimple volume VR of 0.92%. The results are shown in Table 1.

TABLE 1

| | | Example | Comparison |
|---|---|---|---|
| Carry (m) | Pole hitting | 213 | 213 |
| | Seam hitting | 214 | 211 |
| Run (m) | Pole hitting | 14 | 11 |
| | Seam hitting | 13 | 15 |
| Total (m) | Pole hitting | 227 | 224 |
| | Seam hitting | 227 | 226 |

As seen from Table 1, the golf ball of the invention is improved in symmetry so that it offers an increased flight distance and consistent flight performance.

Japanese Patent Application No. 63802/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball having a plurality of dimples in its spherical surface, wherein the surface of said golf ball is divided into twelve congruent phantom spherical equilateral hexagons and six congruent phantom spherical equilateral tetragons such that each phantom spherical equilateral tetragon is surrounded by four phantom spherical equilateral hexagons and the four sides of each phantom spherical equilateral tetragon are coincident with respective sides of the four phantom spherical equilateral hexagons surrounding said tetragon, and three diagonal lines are drawn in each of the phantom spherical equilateral hexagons to equally divide the phantom spherical equilateral hexagon into six phantom spherical triangles, said ball surface being divided into seventy two (72) phantom spherical triangles and six (6) phantom spherical equilateral tetragons, the dimples are arranged on the surface of said golf ball such that the phantom spherical triangles have an identical dimple arrangement and the phantom spherical equilateral tetragons have another identical dimple arrangement, and an identical number of dimples intersect with every side of the 72 phantom spherical triangles and the 6 phantom spherical equilateral tetragons, a great circle which does not intersect with the dimples is not drawable on the ball surface, and a total dimple volume to ball volume ratio VR given as (B/A)×100% is in the range: 0.6%<VR<1.5%, wherein a phantom sphere, derived from a spherical surface of a ball free of dimples, has a volume of A $mm^3$ and the sum of the volumes of dimples distributed throughout the ball is B $mm^3$.

2. The golf ball of claim 1 wherein the number of dimples intersecting with every side of the phantom spherical equilateral tetragons is three, four or five.

3. The golf ball of claim 1 wherein the spaces between the dimples are substantially uniform throughout the golf ball.

4. The golf ball of claim 1 wherein the sum B of the volumes of dimples is from 244 to 610 $mm^3$.

5. The golf ball of claim 1 wherein the total number of dimples is from 350 to 500.

* * * * *